US006371801B1

(12) United States Patent
Kiviniitty

(10) Patent No.: US 6,371,801 B1
(45) Date of Patent: Apr. 16, 2002

(54) ARRANGEMENT FOR FASTENING A PLUG, AND A PLUG

(75) Inventor: Ari Kiviniitty, Hämeenlinna (FI)

(73) Assignee: KCI Konecranes International PLC, Hyvinkaa (FI)

( * ) Notice: Subject to any disclaimer, the term of this patent is extended or adjusted under 35 U.S.C. 154(b) by 0 days.

(21) Appl. No.: 09/708,676

(22) Filed: Nov. 9, 2000

(30) Foreign Application Priority Data

Nov. 9, 1999 (FI) ..... 992412

(51) Int. Cl.[7] ..... H01R 13/73

(52) U.S. Cl. ..... 439/552; 439/536; 439/559; 361/156

(58) Field of Search ..... 439/557, 536, 439/550, 545, 552, 556, 559, 562, 565, 563; 361/156

(56) References Cited

U.S. PATENT DOCUMENTS

| | | | | | |
|---|---|---|---|---|---|
| 1,031,976 | A | * | 7/1912 | Weber | 439/553 |
| 4,453,195 | A | * | 6/1984 | Sauer et al. | 361/156 |
| 4,717,358 | A | | 1/1988 | Chaundy | |
| 4,963,098 | A | | 10/1990 | Myer et al. | |
| 5,205,759 | A | * | 4/1993 | Haderer | 439/545 |
| 5,545,058 | A | * | 8/1996 | Albrecht | 439/557 |
| 5,545,852 | A | * | 8/1996 | Boscher et al. | 439/562 |
| 5,690,512 | A | * | 11/1997 | Zumstein et al. | 439/545 |
| 5,810,618 | A | * | 9/1998 | Barbier et al. | 439/532 |
| 5,896,478 | A | * | 4/1999 | Dauber et al. | 439/536 |
| 6,042,396 | A | * | 3/2000 | Endo et al. | 439/552 |

FOREIGN PATENT DOCUMENTS

EP 0840402 A2 5/1998

OTHER PUBLICATIONS

Han–Snap Technical Specification Brochure (2 pages).

* cited by examiner

*Primary Examiner*—Tho D. Ta
*Assistant Examiner*—Truc Nguyen
(74) *Attorney, Agent, or Firm*—Birch, Stewart, Kolasch & Birch, LLP

(57) ABSTRACT

The invention relates to an arrangement for fastening a plug into the edges of an opening of a case. In the arrangement of the inventions the plug includes, in connection therewith, fastening portions and grooves of varying depths for fastening the plug into the case opening. The arrangement also comprises a flexible element for arranging the plug into the case opening. The invention further relates to a plug to be arranged into the edges of an opening in the case. The plug includes, in connection therewith, fastening portions and grooves of varying depths for fastening the plug into the edges of the case opening, and a flexible element to be placed at the bottom of the deeper groove for arranging the plug into the case opening.

24 Claims, 2 Drawing Sheets

ARRANGEMENT FOR FASTENING A PLUG, AND A PLUG

BACKGROUND OF THE INVENTION

1. Field of the Invention

Figure 1:
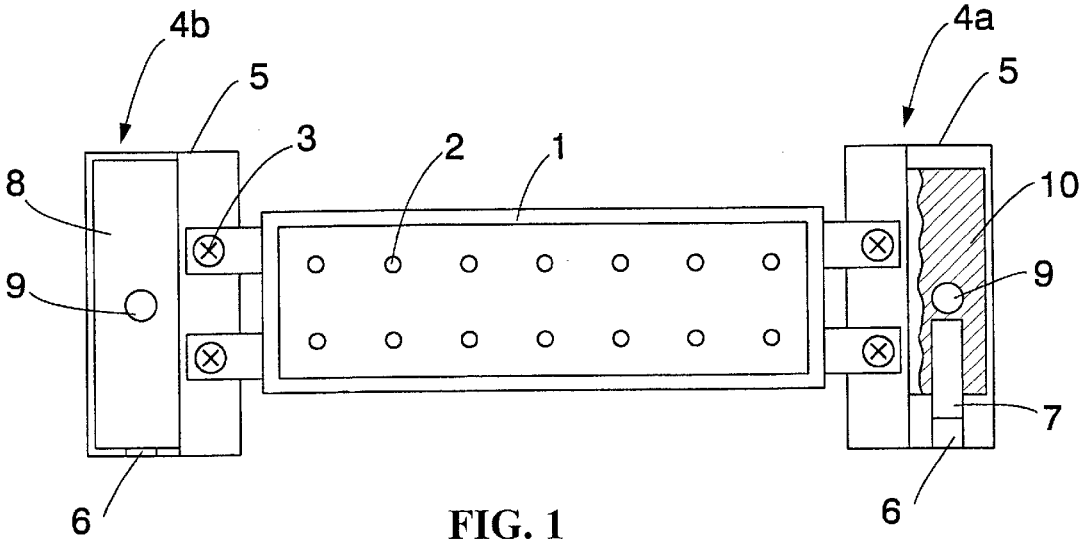

The invention relates to an arrangement for fastening a plug into an opening between two mutually parallel edges, the arrangement comprising at least one fastening portion, at least two grooves and at least one flexible element in connection with the plug.

The invention also relates to a plug comprising, in connection therewith, at least one fastening portion, at least two grooves and at least one flexible element.

2. Description of Background Art

Plugs are commonly used for example for connecting electric wires and data cables into electric appliances. Plugs are typically fastened using screws. A fastening made by means of screws is slow and requires separate tools to be used during fastening. A fastening made by screws is also much too difficult particularly in such arrangements, in which the plug has to be detached, may be more than once, in order to change the internal order of the wires to be coupled to the plug or in order to couple new wires.

It is known in the art to use panel mounting fasteners, which are fastening portions to be separately mounted into the plug, for fastening a plug into an opening formed in a case or between two mounting busbars. A panel mounting fastener comprises a body and flexible strips made of the same material as the body and arranged to the body of the fastening portion, the strips having a substantially rounded groove, into which an edge of the case opening is placed. A panel mounting fastener is fastened at both ends of the plug so that the plug is fastened in the direction of its ends into the case opening using the flexible strips. The drawback with panel mounting fasteners is that the same flexible strips enable to mount the plug into the case opening and form a joint between the edge of the case opening, in which case the joint is not solid enough. Moreover, as the body of the panel mounting fastener and the flexible strips in the fastener form an integral part, the panel mounting fasteners have to be made of such a material that endures bending without breaking.

SUMMARY OF THE INVENTION

It is an object of this invention to provide a simple and reliable arrangement enabling rapid fastening in order to fasten a plug comprising, in connection therewith, means for tightly fastening the plug.

The arrangement of the invention for fastening a plug into an opening between two mutually parallel edges is characterized in that the grooves are directed outwards from the plug and in that a body, a body part and a cover of at least one fastening portion form the first groove arranged against a first edge, and in that the second groove is arranged against a second edge, and in that the groove arranged against the first edge is deeper than the groove arranged against the second edge, and in that the flexible element is placed at the bottom of the deeper groove.

The plug of the invention is characterized in that at least one fastening portion in connection with the plug comprises at least one first groove formed of a body, a body part and a cover of the fastening portion and directed outwards from the plug, the flexible element being placed at the bottom of the first groove, and in that the second groove in connection with the plug is directed substantially in the opposite direction from the plug as regards the first groove and is shallower than the first groove.

The essential idea of the invention is that in order to fasten the plug into an opening between two mutually parallel edges, the plug comprises in connection therewith at least one fastening portion, at least two grooves and at least one flexible element so that the grooves are directed outwards from the plug and in that the body, the body part and the cover of the fastening portion form at least the groove arranged against a first edge, said groove being deeper than the groove arranged against a second edge, and that a flexible element is placed at the bottom of the deeper groove to enable the plug to be mounted into said opening. According to a preferred embodiment of the invention the fastening portion is made into an integral structure together with the plug.

The invention provides such an advantage that the plug can rapidly and easily be mounted and that no tools are needed during installation. The structure of the fastening portion is simple and reliable. The grooves ensure a solid fastening into the edges of the opening. The same fastening portions are applicable in plugs of varying sizes made by different manufacturers. When the plug is fastened to the case, no sub-case of the plug is required, thus saving costs. A further advantage of the invention is the simple form of the opening to be made into the case, on account of which the opening is easy to produce.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Figure 2:
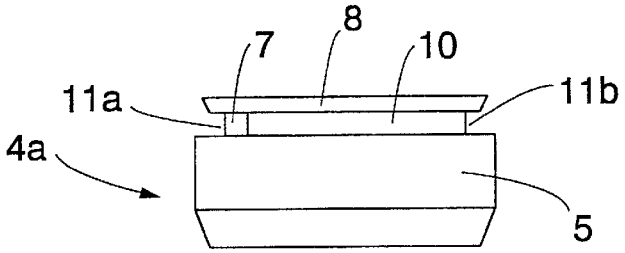
Figure 3:
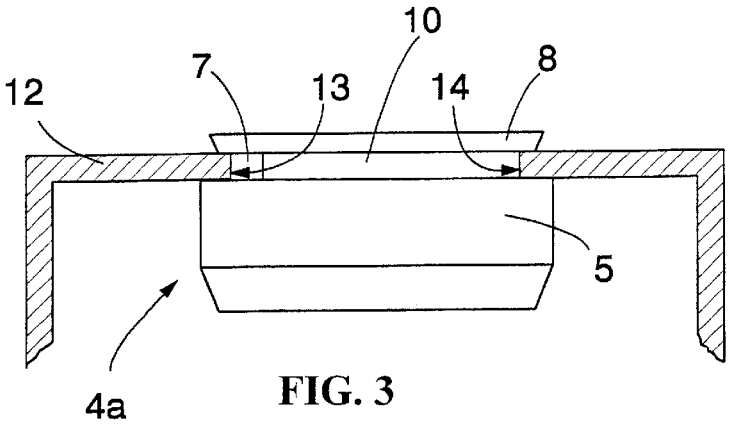
Figure 4:
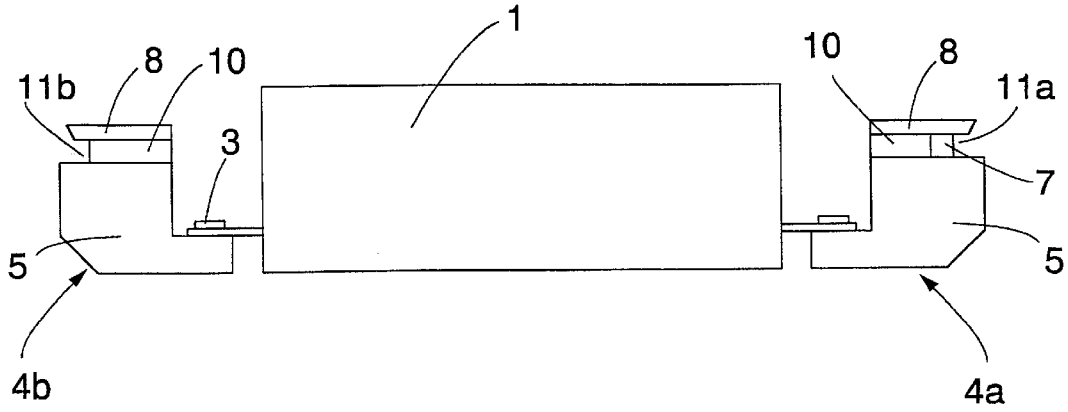

In the following the invention is described in greater detail in the accompanying drawings, in which:

FIG. 1 schematically shows an arrangement of the invention for fastening a plug and a plug of the invention, seen from above the plug and partly cut;

FIG. 2 schematically shows the arrangement of FIG. 1 for fastening the plug, seen from the end of the plug;

FIG. 3 illustrates how the arrangement of the invention shown in FIGS. 1 and 2 is used for fastening the plug into an opening of the case, seen from the end of the plug and partly cut; and FIG. 4 schematically shows a preferred embodiment of another arrangement of the invention for fastening a plug and a plug of the invention seen from the side of the plug.

DESCRIPTION OF THE PREFERRED EMBODIMENTS

FIG. 1 schematically shows an arrangement of the invention for fastening a plug 1, and a plug 1 of the invention, which employs two fastening portions 4*a* and 4*b*, both being fastened at the ends of the plug 1. FIG. 2 illustrates the fastening portion 4*a* of the invention shown in FIG. 1, seen from the end of the plug 1. For clarity, FIG. 2 does not show the plug 1. The plug 1 comprises pins 2 for connecting data cable to the plug 1, for example. The plug 1 is fastened to the fastening portions 4*a* and 4*b* by fastening elements 3, which are preferably screws. The fastening portions 4*a* and 4*b* may be mirror images of one another. The fastening portions 4*a* and 4*b* comprise a body 5, into which a space 6 is formed for a flexible element 7. The body 5 is made of hard, inflexible material, such as plastic, using injection moulding. The flexible element 7 is an elastic element made of for example elastic material, such as rubber. The flexible element 7 can also be a coil spring, but what is essential is that the flexible element 7 is compressible and reversible. The crosscut form of the space 6 and the flexible element 7 may vary, as far as the crosscut forms of the space 6 and the flexible element 7 correspond with one another so that the flexible element 7 is firmly arranged into the space 6. The crosscut of the space 6 and the flexible element 7 preferably resembles a circle. A cover 8 is placed upon the body 5 and the flexible element 7. The cover 8 closes the element 7 into the space 6 so that the flexible element 7 cannot slip from the space 6 when the plug 1 is detached from the fastening object. The cover 8 forms an integral structure with the body 5. The cover 8 includes a hole 9 for fastening the cover of the counterpart of the plug 1. The hole 9 is preferably provided with threads, in which case the cover of the counterpart of the plug 1 can be fastened using screws. The cover 8 has been removed from the fastening portion 4*a* in FIG. 1, and a body part 10 fixedly attached to the body 5 is revealed beneath the cover 8. The structure of the body 5, the body part 10 and the cover 8 of the fastening portions 4*a* and 4*b* is such that a groove 11*a* directed outwards from the plug 1 remains between the body 5 and the cover 8 at one end of the fastening portions 4*a* and 4*b*, and a groove 11*b* directed outwards from the plug 1 remains between the body 5 and the cover 8 at the other end of the fastening portions 4*a* and 4*b*. The grooves 11*a* hand 11*b* are substantially rectangular as regards length, depth and height. The grooves 11*a* and 11*b* are entirely outside the outlines of the plug 1. The grooves 11*a* and 11*b* are also substantially parallel and substantially at the same level with one another. The depth of the groove 11*a* in the direction of the longitudinal axis of the flexible element 7 in FIG. 1 exceeds the depth of the groove 11*b*. The space 6 and the flexible element 7 are arranged at the particular side of the fastening portions 4*a* and 4*b*, to which the groove is formed. The space 6 and the flexible element 7 are such in length that the flexible element 7 extends to the area of the groove 11*a* outlined by the body 5, the body part 10 and the cover 8 in order to enable the yielding movement needed during the installation of the plug 1. The flexible element 7 does not extend to the area of the groove 11*b* outlined by the body 5, the body part 10 and the cover 8, but is restricted to an area inside the body 5 and the body part 10.

FIG. 3 shows by way of example how the arrangement of the invention can be used for fastening the plug 1, seen from the end of the plug 1, when the fastening portion 4*a* is fastened into the edges 13 and 14 of an opening formed in a case 12. For clarity, FIG. 3 does not show the plug 1. When mounting the plug 1, the edge 13 of the opening is arranged into the case 12 opening against the flexible elements 7 in the grooves 11*a* of the fastening portions 4*a* and 4*b*. After this, the fastening portions 4*a* and 4*b* are pressed against the edge 13 of the case 12 opening, whereby the flexible elements 7 are compressed so that the edge 14 of the case 12 opening can be directed to the grooves 11*b* of the fastening portions 4*a* and 4*b*. When detaching the grip, the flexible elements 7 expand and tighten the joint between the grooves 11*a* and 11*b* and the edges 13 and 14. The grooves 11*a* and 11*b* and the flexible element 7 ensure a solid fastening of the fastening portions 4*a* and 4*b* to the case 12 opening in the lateral and vertical direction of the case 12. Since the plug 1 is fastened into the edges 13 and 14 of the case 12 opening by means of the grooves 11*a* and 11*b* formed of the solid and hard surfaces of the fastening portions 4*a* and 4*b*, and since the compressibility of the flexible element 7 only allows the edges 13 and 14 of the case 12 opening to be directed into the grooves 11*a* and 11*b*, the plug 1 cannot by accident slip from the case 12. When detaching the plug 1 from the case 12, the fastening portions 4*a* and 4*b* are pressed against the edge 13 of the case 12 opening, in which case the edge 14 of the case 12 opening can be directed from the grooves 11*b* when the flexible elements 7 are compressed, and the plug 1 can thereafter be removed from the case 12 opening.

FIG. 4 schematically shows another embodiment of an arrangement of the invention for fastening the plug 1 and a plug 1 according to the invention, seen from the side of the plug 1. In the arrangement shown in FIG. 4 fastening portions 4*a* and 4*b* are fastened to the plug 1 using fastening elements 3. The fastening portion 4*a* comprises a groove 11*a* which is directed outwards from the plug 1 and restricted by the body 5, the body part 10 and the cover 8, and a flexible element 7 is arranged at the bottom of the groove. The fastening portion 4*b*, in turn, comprises a groove 11*b* which is directed outwards from the plug 1 and restricted by the body 5, the body part 10 and the cover 8, and a flexible element 7 is not arranged at the bottom of the groove 11*b*. The use of the embodiment shown in FIG. 4 corresponds with the one in FIG. 3. The embodiment according to FIG. 4 can also be implemented so as to form the groove 11*b* into the body of the plug 1, if the body of the plug 1 is solid enough to endure the load caused by fastening, in which case no fastening portion 4*b* is required.

According to a preferred embodiment of the invention the fastening portions 4*a* and 4*b* are formed into an integral structure with the plug 1 during the fabrication of the plug 1, whereby no separate fastening elements 3 are required for fastening the plug 1 to the fastening portions 4*a* and 4*b*.

The drawing and the specification associated thereto are merely intended to illustrate the inventive idea. The details of the invention may vary within the scope of the claims. Hence, the appearance and the structure of the plug 1 and the fastening portions 4*a* and 4*b* may vary from what is illustrated in FIGS. 1 to 4, whereas the principle of the invention remains the same. The scale of dimensions of the plug 1 and the fastening portions 4*a* and 4*b* may vary from what is shown in FIGS. 1 to 4. Furthermore, the plug 1 can be fastened to the case 12 from above or below the opening. The fastening object of the plug 1 is not necessarily the case opening but it may also be placed between two parallel busbars or in a corresponding opening between two mutually parallel edges. Several plugs 1 can also at first be fastened together to form a line of plugs, and the fastening portions 4*a* and 4*b* can be used for fastening the line of plugs. If the plug 1 and the fastening portions 4*a* and 4*b* form separate structures, other corresponding fastening elements 3 can be used instead of screws as the fastening elements 3 in order to fasten the plug 1 to the fastening portions 4*a* and 4*b*, or the fastening portions 4*a* and 4*b* can be provided with grooves and the plug 1 can be fastened to the locking pins in the grooves by pressing.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An arrangement for fastening a plug into an opening between two mutually parallel edges, the arrangement comprising:

at least two grooves directed outward from the plug;

at least one fastening portion, said at least one fastening portion including a body, a body part and a cover forming a first of said at least two grooves, said first groove for being arranged against a first of said mutually parallel edges;

a second of said at least two grooves for being arranged against a second of said mutually parallel edges, said first groove being deeper than said second groove;

at least one flexible element, said at least one flexible element being placed at a bottom of said first groove; and at least one fastening element fastening the plug to said at least one fasting portion.

2. The arrangement as claimed in claim 1, wherein the body, the body part and the cover of said at least one fastening portion form said second groove, said second groove being arranged into a same of said at least one fastening portions as said first groove, said second groove being on an opposite side of the plug from said first groove.

3. The arrangement as claimed in claim 1, wherein the body, the body part and the cover of said at least one fastening portion form said second groove, said second groove being arranged into a different of said at least one fastening portions than said first groove, said second groove being on an opposite side of the plug from said first groove.

4. The arrangement as claimed in claim 1, wherein said second groove is arranged into the body of the plug on an opposite side of the plug than said first groove.

5. The arrangement as claimed in claim 1, wherein said first groove and said second groove are substantially at the same level.

6. The arrangement as claimed in claim 1, wherein said first groove and said second groove are substantially rectangular.

7. The arrangement as claimed in claim 1, wherein the flexible element is compressible and reversible.

8. The arrangement as claimed in claim 2, wherein the plug is fastened using two of said at least one fastening portions in the plug on opposite sides of the plug.

9. The arrangement as claimed in claim 8, wherein the flexible element is a coil spring.

10. The arrangement as claimed in claim 8, wherein the flexible element is made of elastic material.

11. The arrangement as claimed in claim 10, wherein the flexible element is made of rubber.

12. A plug comprising:

at least two grooves;

at least one fastening portion, said at least one fastening portion including at least one first groove of said at least two grooves formed of a body, a body part and a cover of said at least one fastening portion, said at least one first groove being directed outwards from the plug;

at least one second groove of said at least two grooves, said at least one second groove being directed substantially in an opposite direction from the plug than said at least one first groove, said at least one second groove being shallower than said at least one first groove;

at least one flexible element, said at least one flexible element being placed at a bottom of said at least one first groove; and at least one fastening element fastening the plug to said at least one fastening portion.

13. The plug as claimed in claim 12, wherein said at least one second groove is formed by the body, the body part and the cover of said at least one fastening portion, said at least one second groove being arranged into a same of said at least one fastening portions as said at least one first groove, said at least one second groove being on an opposite side of the plug from said at least one first groove.

14. The plug as claimed in claim 12, wherein said at least one second groove is formed by the body, the body part and the cover of said at least one fastening portion, said at least one second groove being arranged into a different of said at least one fastening portions than said at least one first groove on an opposite side of the plug.

15. The plug as claimed in claim 12, wherein said at least one second groove is arranged into the body of the plug on an opposite side of the plug than said at least one first groove.

16. The plug as claimed in claim 12, wherein at least one first groove and said at least one second groove are substantially at the same level.

17. The plug as claimed in claim 12, wherein said at least one first groove and said at least one second groove are substantially rectangular.

18. The plug as claimed in claim 12, wherein the body, the body part and the cover of the at least one fastening portion form an integral structure.

19. The plug as claimed in claim 12, wherein the at least one fastening element is at least one screw.

20. The plug as claimed in claim 12, wherein the at least one fastening element is at least one locking pin in the at least one fastening portion.

21. The plug as claimed in claim 12, wherein the flexible element is compressible and reversible.

22. The plug as claimed in claim 21, wherein the flexible element is a coil spring.

23. The plug as claimed in claim 21, wherein the flexible element is made of elastic material.

24. The plug as claimed in claim 23, wherein the flexible element is made of rubber.

* * * * *